US005632558A

United States Patent [19]

Baker

[11] Patent Number: 5,632,558

[45] Date of Patent: May 27, 1997

[54] CONTAINER FOR COMPRESSED ARTICLES

[75] Inventor: Barry P. Baker, Co. Down, Ireland

[73] Assignee: Gallaher Limited, Weybridge, United Kingdom

[21] Appl. No.: 583,119

[22] PCT Filed: Jul. 1, 1994

[86] PCT No.: PCT/GB94/01430

§ 371 Date: Feb. 12, 1996

§ 102(e) Date: Feb. 12, 1996

[87] PCT Pub. No.: WO95/02545

PCT Pub. Date: Jan. 26, 1995

[30] Foreign Application Priority Data

Jul. 15, 1993 [GB] United Kingdom ..... 9314689

[51] Int. Cl.[6] ..... B65D 30/16; B65D 33/28

[52] U.S. Cl. ..... 383/75; 206/83.5; 383/121.1

[58] Field of Search ..... 383/72, 73, 74, 383/75, 76, 121.1; 206/83.5

[56] References Cited

U.S. PATENT DOCUMENTS

| | | | |
|---|---|---|---|
| 2,610,757 | 9/1952 | Irvine | 383/76 |
| 2,713,370 | 7/1955 | Quinn . | |
| 2,955,741 | 10/1960 | Piazze . | |
| 3,425,472 | 2/1969 | Marino | 383/76 |
| 4,739,880 | 4/1988 | Sawyer et al. | 383/72 |
| 5,439,109 | 8/1995 | McBride | 383/121.1 |

FOREIGN PATENT DOCUMENTS

| | | |
|---|---|---|
| 0 266 923 | 5/1988 | European Pat. Off. . |
| 0 371 539 | 6/1990 | European Pat. Off. . |
| 4024630 | 2/1992 | Germany . |
| 2 194 770 | 3/1988 | United Kingdom . |

OTHER PUBLICATIONS

International Search Report RE PCT/GB94/01430, Filed 01 Jul. 1994.

*Primary Examiner*—Stephen P. Garbe
*Attorney, Agent, or Firm*—Baker & Daniels

[57] ABSTRACT

A container, for a compressed block of tobacco, the container comprising a rectangular bottom, front, rear and two side walls (15,16,17,18), of which at least the front, rear and side walls are formed of pliable, non-shape sustaining fabric, the front, rear and side walls each having along its upper edge a strip forming a flap (20) which is arranged to be folded inwards to provide a partial top wall, the flaps providing a tubular guide (11) containing at least one drawstring (21) which is/are exposed at notches (23,22) part-way along each of the front and rear walls and at the corners of the partial top wall, whereby the drawstring(s) may be pulled up at at least one of the portions exposed in the front and rear wall notches to pull the flaps inwards, and means (24) for readily connecting the portions exposed in the front and rear wall notches to hold the drawstring(s) pulled up to a predetermined extent.

20 Claims, 2 Drawing Sheets

CONTAINER FOR COMPRESSED ARTICLES

The invention relates to containers for use in transporting tobacco, such as raw tobacco leaf or reconstituted tobacco, e.g. from the country of origin to the country of finished product manufacture.

Traditionally, raw tobacco is heated and made pliable in the presence of steam, and while in this state, it is fed into an hydraulic press which compresses a column of leaf from about 1000 cm down to about 70 cm into a cardboard carton. The press works over an empty carton containing a steel sleeve. When the press head returns on its up stroke the sleeve is removed and the flaps of the carton are closed, and the carton strapped. The tobacco is then often impregnated with a gaseous fumigant.

Such cardboard cartons need external strapping, because the tobacco tries to spring up before it has cooled. This strapping step is time consuming and adds additional cost to that of the carton. The cartons are inherently vulnerable to damage, particularly when wet, during handling, e.g. by a fork lift truck, or by being partially collapsed when stacked owing to shrinkage of the contents.

These problems have been overcome by a container of the kind described in our EP-A-0266923, which comprises rectangular bottom, top, front, rear and two side walls made of pliable woven polypropylene fabric, the top wall being connectable by a sliding clasp fastener along its front and side edges to the adjacent upper edges of the front and side walls. A container of this construction may be filled in a substantially conventional manner and, after withdrawal of the ram and sleeve, the top wall may be quickly folded down and secured by the fastener to the front and side walls quickly and before any significant expansion of the compressed tobacco occurs. Furthermore the container may be reused many times, as it is virtually indestructible when handled. In particular, it may be returned for refilling in a completely collapsed state in which it occupies minimum volume.

However, one problem with this improved container is that the sliding clasp fastener is an expensive component and its stitching to the edges of the top, front and side walls is time consuming and expensive. Also the container walls have had to be made of polypropylene, rather than cheaper jute, hessian or hemp, in order to provide an adequately strong support for the lock stitching by which the fastener is sewn in. Furthermore, suitable fasteners have been made of materials other than polypropylene and, when the container must ultimately be disposed of, it is desirable for the polypropylene to be recycled but this cannot be done without tediously cutting the lock stitching to remove the fastener, and this is expensive. Consequently, the containers have tended to be dumped in land fill sites, which is environmentally unfriendly.

U.S. Pat. No. 2,713,370 discloses a bag for packaging elongate products, such as vegetables in which the upper edges of front, rear, and side walls can be folded inwards to provide a partial top wall by means of a drawstring. However, the drawstring is woven to and fro through the fabric and when the drawstring is pulled up, the fabric is gathered to form the partial top wall, rather than forming flaps which lie flat. Both these factors provide significant friction and hence render it impossible to pull up the drawstring quickly. Also, the drawstring is arranged to be knotted and this involves significant time. Furthermore the extent to which the drawstring is to be pulled up depends upon the extent to which the bag has been filled. All these factors are not problems when packaging a stack of static vegetables but would be quite unacceptable for the present purpose in which a highly compressed block of tobacco has to be closed in a container of precise height substantially instantaneously after the press head has been removed and before any significant expansion of the tobacco has occurred.

In accordance with the present invention, a container for a compressed block of tobacco comprises rectangular bottom, front, rear and two side walls, of which at least the front, rear and side walls are formed of pliable, non-shape sustaining fabric, the front, rear and side walls each having along its upper edge a strip forming a flap which is arranged to be folded inwards to provide a partial top wall, the flaps providing a tubular guide containing at least one drawstring which is/are exposed at discontinuities in the guide part-way along each of the front and rear walls and at the corners of the partial top wall, whereby the drawstring(s) may be pulled up at at least one of the portions exposed in the front and rear wall discontinuities to pull the flaps inwards, and means for readily connecting the portions exposed in the front and rear wall discontinuities to hold the drawstring(s) pulled up to a predetermined extent.

As compared to the use of a top wall with a sliding clasp fastener around three of its edges, the use of the upper edge flaps and drawstring(s) results in a significantly cheaper construction with a minimum, if any, of components of a material different from that from which the walls are made. Consequently if the walls are made of polypropylene, as is preferred, recycling of old bags involves less of a problem. However other materials, particularly natural materials, such as jute, hessian or hemp, may be used. When a block of tobacco has been compressed within the container and the sleeve removed, the drawstring can be pulled up, and the portions exposed in the front and rear wall discontinuities interconnected to hold the flaps folded inwards, as quickly, and probably more quickly, than the time previously taken to close the sliding clasp fastener around three edges of the top wall.

Depending upon the extent to which the flaps extend inwardly to form a partial top wall, they may or may not be sufficient in themselves to maintain the block of tobacco compressed downwardly. If not, then it will be necessary to provide some sheet reinforcement, such as a bale board and/or a sheet of cardboard, on top of the block of compressed tobacco before the flaps are folded inwardly by pulling in the drawstring(s).

The discontinuities in the tubular guide are necessary part-way, preferably mid-way, along the front and rear wall flaps to enable pulling up of the drawstring(s), and their ready interconnection. The speed with which the drawstring (s) can be pulled up is important and is facilitated by the drawstring(s) being exposed at the additional discontinuities at the corners of the partial top wall, so that as the drawstring (s) is/are pulled up the flap material does not pucker at the corners and impede longitudinal movement of the drawstring(s). The flaps can then also lie flat with effectively mitred corners to the top wall.

Although two drawstrings may be provided, each fixed at its ends part way along one of the side wall flaps and extending around a respective front or rear wall flap, a single continuous drawstring extending around all four flaps is preferred.

The tubular guide for the drawstring(s) may consist of a series of metal or plastics rings attached to the flap portions of the walls. The discontinuities would then be provided by the gaps between the rings. Preferably, however, the tubular guide is formed by a portion of the wall fabric folded over and stitched down, the discontinuities being cut in the folded portions.

The means for readily connecting to a predetermined extent the portions of the drawstring(s) exposed part-way along the front and rear wall flaps is preferably a hook connected to one of the exposed portions and readily engageable with the other. In practice a single drawstring may then be drawn up by grasping the hook, pulling it inwardly from its respective front or rear wall flap and hooking it over the opposite portion of the drawstring exposed in the opposite wall flap.

A further minor disadvantage of the earlier container disclosed in EP-A-0266923 is that it was constructed from a web of material forming the top, rear, bottom and front walls of the container, and two end panels which were stitched around three of their edges to the adjacent edges of the rear, bottom and front walls. This resulted in four vertical seams at the four vertical corner edges of the container. The stitching of these seams inevitably involved some tolerance and consequently an undesirable aggregate tolerance existed in the peripheral dimension of the container in a horizontal plane. This involved difficulties in ensuring that the ram sleeve fitted exactly into the container during compression of the block of tobacco in the container.

It is now envisaged that this minor disadvantage can be overcome by forming the new container from a single web of fabric extending around the front, rear and side walls of the container and rendered continuous by a single vertical seam interconnecting the ends of the web, at one position, the bottom wall being closed by providing a seam joining the lower edges of the web along a central line of the bottom wall, and forming the rectangular configuration of the bottom wall by folding the fabric at the side walls inwardly and stitching the lower edges at the inwardly folded parts into the central seam along the bottom wall. When this pleated configuration is opened, it naturally forms a rectangular bottom wall with the necessary rectangular front, rear and side walls, upward extensions of which form the flaps. Since, the side walls only include one vertical seam, tolerances in the horizontal dimensions of the container can be much tighter than before.

Otherwise the new container has the advantages of the earlier container, namely in that it is virtually indestructible and may be returned for filling in a completely collapsed state in which it occupies minimum volume.

A typical container in accordance with the invention will have a length of at least 80 cm, preferably of the order of 110–115 cm, a width of at least 50 cm, preferably of the order of 65–75 cm, and a height of at least 35 cm, preferably at least 50 cm, and most preferably of the order of 70–75 cm. A container with the above preferred dimensions will be capable of containing a block of natural tobacco leaf with a weight of the order of 200 kg.

An example of a container constructed in accordance with the present invention is illustrated somewhat diagrammatically in the accompanying drawings, in which.

Figure 1:
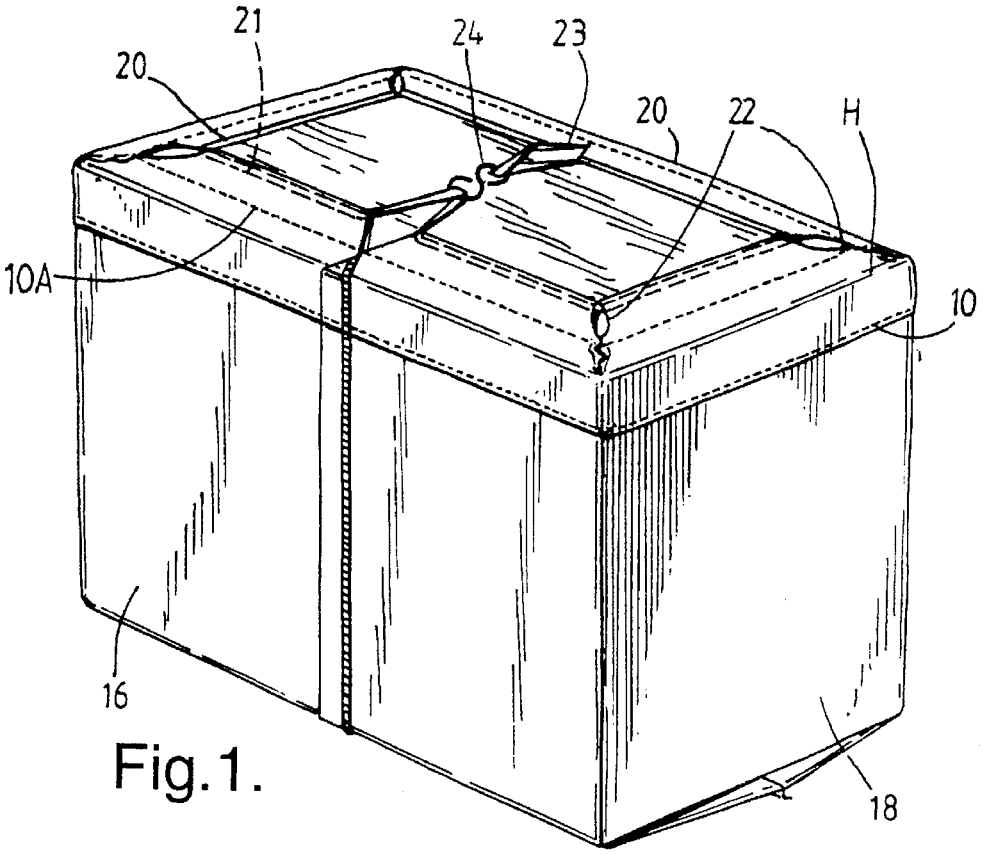
FIG. 1 is a perspective view showing the container filled and closed.
Figure 2:
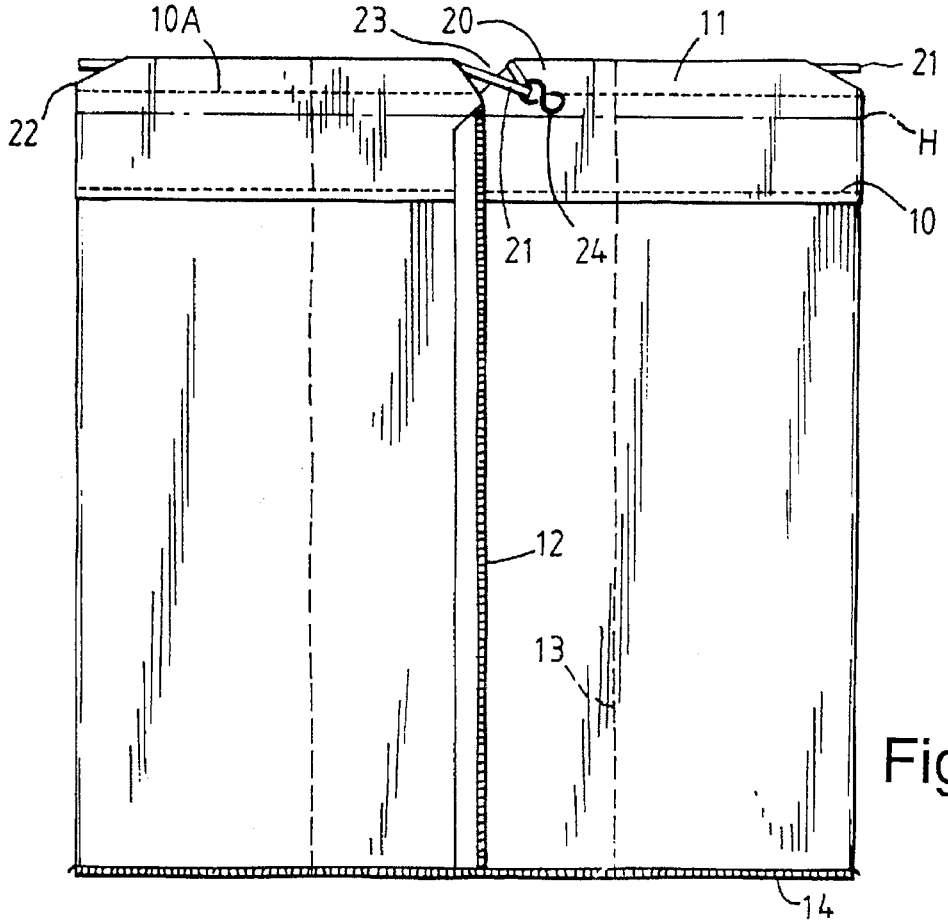
FIG. 2 is a front elevation illustrating how the container is made.

The container shown in FIGS. 1 to 4 is formed essentially from a web 135 cm wide of flexible woven polypropylene fabric having a weight of 250 g/sq m and woven from warp and weft yarn of 2000 denier. The web is 360 cm long, that is just sufficient to extend around the front, rear and sides of the container. A strip, 20 cm wide, along one longer edge of the web is folded over and stitched down to the web by a line of stitching 10, and by a line of stitching 10A some 5 cm from the top edge to form along that edge of the web a tubular portion 11. The end edges of the web are then brought together and connected by blanket stitching 12. The tubular blank thus formed is flattened as shown in FIG. 2 with the line of stitching 12 centrally in one of the two layers of fabric. End portions each 68 cm wide are then folded inwardly between the two layers in pleat-like fashion up to lines 13. The edges of the fabric layers which are seen as lowermost in FIG. 2 are then united by a line of blanket stitching 14, the lower edges of the pleated portions thus being caught in by the stitching. Both lines 12 and 4 of stitching use polypropylene thread of 5000 denier.

The container may then be opened out into one of rectangular parallelepiped shape having a bottom wall 15 with dimensions 68 cm by 112 cm, and the line of stitching 14 extending centrally along the centre of the bottom wall. Upstanding from the bottom wall will then be front and rear walls 16 and 17 and side walls 18, each formed by unfolding of the pleated portions with the lower parts of these portions remaining overlying the bottom wall in a triangular configuration shown at 19 in FIG. 4.

Figure 3:
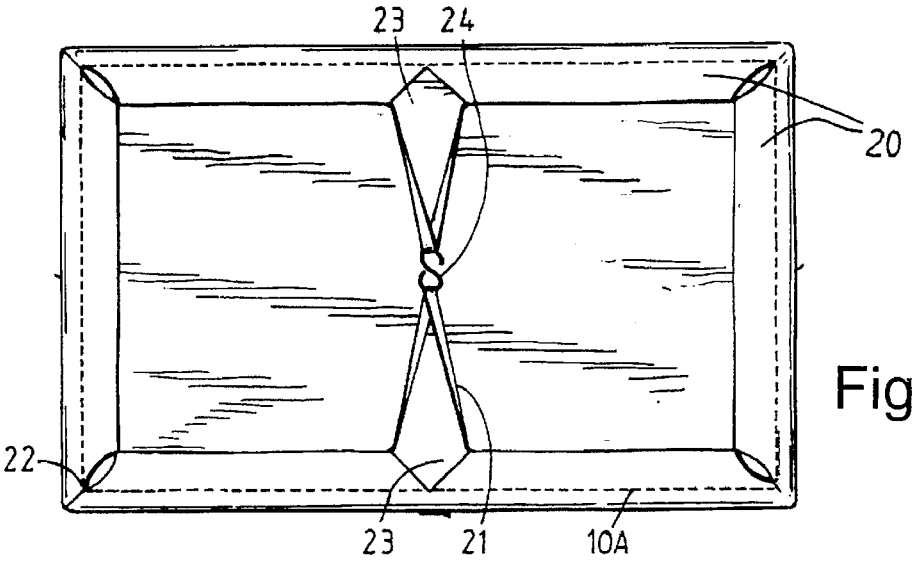
FIG. 3 is a plan showing the container filled and closed.
Figure 4:
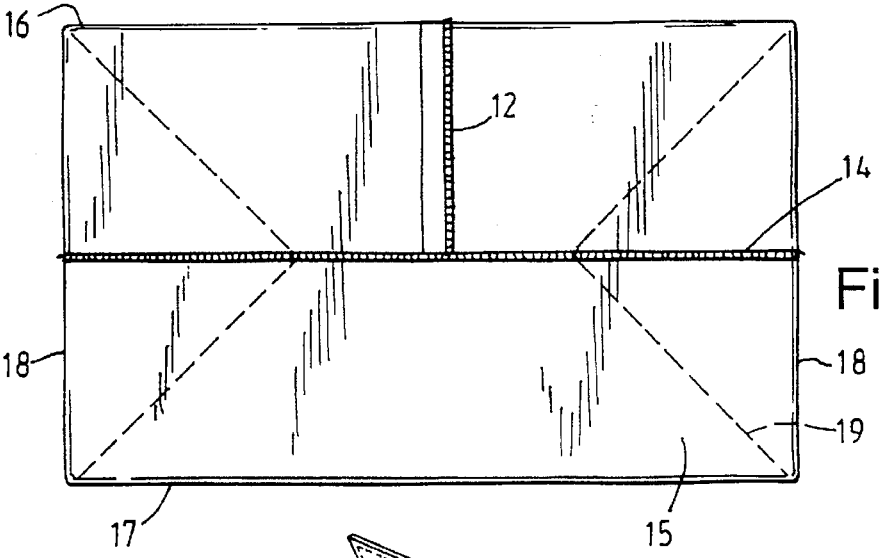
FIG. 4 is an underneath plan of the container.

The nominal upper edges of the front, rear and side walls terminate at a height H, some 73 cm above the bottom wall. However these walls extend a further 8 cm above the height H to provide flaps 20 which may be folded inwardly as shown in FIGS. 1 and 3 to provide a partial top wall.

A drawstring 21 is threaded around within the tubular portion 11 and is exposed at notches 22 in the upper edges of the flaps at each of the four corners of the container, and at two notches 23 respectively positioned mid-way along the upper edge of the front and rear wall flaps. The part of the drawstring initially exposed in the notch 23 in the front wall flap is provided with a captive S-shaped hook element 24, one end of which has a closed loop encircling the drawstring and the other end of which provides an open hook. The notches 22 are provided primarily not for exposing the drawstring 21, but to allow the flaps to be folded inwardly without interference with one another by puckering at the corners of the container, and hence to minimise friction between the drawstring and fabric as the drawstring is pulled up.

In use the container is opened and a board, such as a slatted wooden bale board, only slightly smaller than the internal plan area of the container is inserted into the bottom of the container. A thin plastics waterproof liner is then inserted on top of the board. The conventional sleeve is then inserted and a block of tobacco is formed within the lined container by ramming a loose column of tobacco down. When the tobacco block has been compressed to a height below that to which it may ultimately expand in the container, the sleeve is removed, and, in quick succession, the upper part of the liner is folded down and covered with a board, preferably a sheet of cardboard superposed by a slatted wooden bale board, and the drawstring is pulled up by pulling the hook element inwardly and hooking it over the part of the drawstring exposed in the opposite notch 23. This action ensures that the drawstring is pulled up by a predetermined amount so that the flaps 20 are pulled inwardly to overlie the edges of the board and secure the container for transport.

Figure 5:
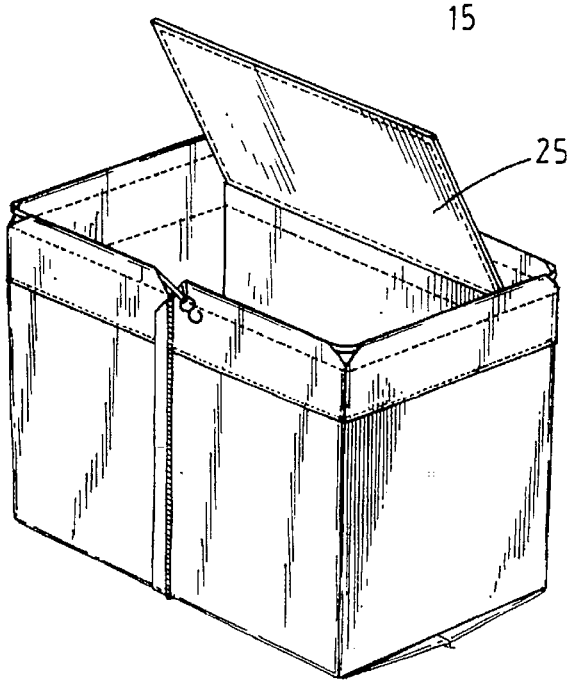
FIG. 5 is a perspective view of a modified container prior to filling.

FIG. 5 shows a modification which differs from the first example essentially only in the provision of a top wall 25 which is stitched to the top of the rear wall inside the rear wall flap, and may be folded down over the upper board prior to pulling up the drawstring and securing the container.

I claim:

1. A container, for a compressed block of tobacco, the container comprising rectangular bottom, front, rear and two side walls, of which at least the front, rear and side walls are formed of pliable, non-shape sustaining fabric, the front, rear and side walls each having along its upper edge a strip forming a flap which is arranged to be folded inwards to provide a partial top wall, the flaps providing a tubular guide containing at least one drawstring which is exposed at discontinuities in the guide part-way along each of the front and rear walls and at the corners of the partial top wall, whereby said at least one drawstring may be pulled up at at least one of the portions exposed in the front and rear wall discontinuities to pull the flaps inwards, and means for readily connecting the portions exposed in the front and rear wall discontinuities to hold said at least one drawstring pulled up to a predetermined extent.

2. A container according to claim 1 wherein the front and rear wall discontinuities are mid-way along the front and rear wall flaps.

3. A container according to claim 2, wherein the tubular guide is formed by a portion of the wall fabric folded over and stitched down, and the discontinuities are formed by notches cut in the folded portion.

4. A container according to claim 2, wherein a single continuous drawstring is provided, extending around all four flaps.

5. A container according to claim 2, wherein the means for readily connecting the portions of said at least one drawstring exposed part-way along the front and rear wall flaps is a hook connected to one of the exposed portions and readily engageable with the other exposed portion.

6. A container according to claim 2, wherein the container is formed from a single web of fabric extending around the front, rear and side walls of the container and rendered continuous by a single vertical seal interconnecting the ends of the web, at one position, the bottom wall being closed by providing a seam joining the lower edges of the web along a central line of the bottom wall, and forming the rectangular configuration of the bottom wall by folding the fabric at the side walls inwardly and stitching the lower edges at the inwardly folded parts into the central seam along the bottom wall.

7. A container according to claim 2, which also has a board which is arranged to fit in the top of the container, in use overlying the contents, and to be overlaid by the flaps.

8. A container according to claim 1 wherein the tubular guide is formed by a portion of the wall fabric folded over and stitched down, and the discontinuities are formed by notches cut in the folded portion.

9. A container according to claim 8, wherein a single continuous drawstring is provided, extending around all four flaps.

10. A container according to claim 8, wherein the means for readily connecting the portions of said at least one drawstring exposed part-way along the front and rear wall flaps is a hook connected to one of the exposed portions and readily engageable with the other exposed portion.

11. A container according to claim 8, wherein the container is formed from a single web of fabric extending around the front, rear and side walls of the container and rendered continuous by a single vertical seal interconnecting the ends of the web, at one position, the bottom wall being closed by providing a seam joining the lower edges of the web along a central line of the bottom wall, and forming the rectangular configuration of the bottom wall by folding the fabric at the side walls inwardly and stitching the lower edges at the inwardly folded parts into the central seam along the bottom wall.

12. A container according to claim 8, which also has a board which is arranged to fit in the top of the container, in use overlying the contents, and to be overlaid by the flaps.

13. A container according to claim 1, wherein a single continuous drawstring is provided, extending around all four flaps.

14. A container according to claim 13, wherein the means for readily connecting the portions of said at least one drawstring exposed part-way along the front and rear wall flaps is a hook connected to one of the exposed portions and readily engageable with the other exposed portion.

15. A container according to claim 13, wherein the container is formed from a single web of fabric extending around the front, rear and side walls of the container and rendered continuous by a single vertical seal interconnecting the ends of the web, at one position, the bottom wall being closed by providing a seam joining the lower edges of the web along a central line of the bottom wall, and forming the rectangular configuration of the bottom wall by folding the fabric at the side walls inwardly and stitching the lower edges at the inwardly folded parts into the central seam along the bottom wall.

16. A container according to claim 13, which also has a board which is arranged to fit in the top of the container, in use overlying the contents, and to be overlaid by the flaps.

17. A container according to claim 1 wherein the means for readily connecting the portions of said at least one drawstring exposed part-way along the front and rear wall flaps is a hook connected to one of the exposed portions and readily engageable with the other exposed portion.

18. A container according to claim 17, wherein the container is formed from a single web of fabric extending around the front, rear and side walls of the container and rendered continuous by a single vertical seal interconnecting the ends of the web, at one position, the bottom wall being closed by providing a seam joining the lower edges of the web along a central line of the bottom wall, and forming the rectangular configuration of the bottom wall by folding the fabric at the side walls inwardly and stitching the lower edges at the inwardly folded parts into the central seam along the bottom wall.

19. A container according to claim 1 wherein the container is formed from a single web of fabric extending around the front, rear and side walls of the container and rendered continuous by a single vertical seal interconnecting the ends of the web, at one position, the bottom wall being closed by providing a seam joining the lower edges of the web along a central line of the bottom wall, and forming the rectangular configuration of the bottom wall by folding the fabric at the side walls inwardly and stitching the lower edges at the inwardly folded parts into the central seam along the bottom wall.

20. A container according to claim 1 which also has a board which is arranged to fit in the top of the container, in use overlying the contents, and to be overlaid by the flaps.

* * * * *